United States Patent [19]

Vertegaal et al.

[11] 4,217,821

[45] Aug. 19, 1980

[54] PRINTING APPARATUS UTILIZING FLEXIBLE METAL SLEEVES AS INK TRANSFER MEANS

[75] Inventors: Jacobus-Gerardus Vertegaal, Boxmeer; Lodewijk Anselrode, St. Anthonis, both of Netherlands

[73] Assignee: Stork Brabant B.V., Boxmeer, Netherlands

[21] Appl. No.: 13,049

[22] Filed: Feb. 21, 1979

Related U.S. Application Data

[63] Continuation-in-part of Ser. No. 864,332, Dec. 27, 1977, abandoned.

[51] Int. Cl.[2] ..... B41F 15/10; B41F 15/38; B41F 27/12

[52] U.S. Cl. ..... 101/181; 101/118; 101/128.1; 101/248; 101/348; 101/375; 101/415.1; 29/113 R

[58] Field of Search ..... 101/115, 116, 117, 118, 101/119, 120, 127, 127.1, 128, 128.1, 348, 129, 181, 349, 248, 375, 376, 415.1, 378, 382 MV; 204/11, 6, 12, 9; 29/113 R, 113 AD; 355/3 DR, 87, 92; 425/368; 100/163 A, 163 R, 170

[56] References Cited

U.S. PATENT DOCUMENTS

| | | | |
|---|---|---|---|
| 2,144,793 | 1/1939 | Christensen | 29/113 R X |
| 2,182,176 | 12/1939 | Maranurce | 29/113 R X |
| 2,255,410 | 9/1941 | Case | 101/348 X |
| 2,287,122 | 6/1942 | Norris | 101/128.2 X |
| 2,289,453 | 7/1942 | Randall | 29/113 R X |
| 2,987,994 | 6/1961 | Allison | 29/113 R X |
| 3,006,277 | 10/1961 | Willard | 101/378 |
| 3,224,698 | 12/1965 | Conti | 29/113 R X |
| 3,253,323 | 5/1966 | Saueressig | 29/113 R |
| 3,640,218 | 2/1972 | Allison | 101/375 |
| 3,695,757 | 10/1972 | Gregory | 101/378 X |
| 3,971,313 | 7/1976 | Voegelin | 101/127.1 |
| 4,000,242 | 12/1976 | Hartbauer | 101/376 |
| 4,025,339 | 5/1977 | Kuehnce | 96/1.5 |
| 4,089,265 | 5/1978 | White et al. | 101/375 |

FOREIGN PATENT DOCUMENTS

| | | | |
|---|---|---|---|
| 219268 | 1/1962 | Austria | 29/113 R |
| 279107 | 8/1913 | Fed. Rep. of Germany | 29/113 R |

*Primary Examiner*—J. Reed Fisher

*Attorney, Agent, or Firm*—Silverman, Cass & Singer

[57] ABSTRACT

Printing apparatus utilizing flexible metal sleeves for ink transfer comprises means for mounting the sleeves in cylindrical configuration on a structure which enables the cylindrical configuration to be maintained by air pressure. The sleeves are of the type which is made by electrodepositing metal in a form that is very thin, readily collapsible and imperforate.

The sleeve of the apparatus is provided on its exterior with a coating of flexible, microcrystalline, wholly inorganic photoconductive material such as sputtered ultrapure cadmium sulfide.

The sleeve is mounted in a press having means to cooperate with the sleeve for maintaining its pressure and for stopping the press if the pressure should drop below a predetermined value.

8 Claims, 4 Drawing Figures

PRINTING APPARATUS UTILIZING FLEXIBLE METAL SLEEVES AS INK TRANSFER MEANS

CROSS-REFERENCE TO RELATED APPLICATION

This application is a continuation-in-part of copending application Ser. No. 864,332 filed Dec. 27, 1977, now abandoned, having the same title and applicants and owned by the same assignee.

The disclosure of the copending application is incorporated herein by reference.

FIELD AND BACKGROUND OF THE INVENTION

The field and background of the invention herein are the same as those of the copending application which is incorporated herein by reference. A short summary thereof is included hereinafter.

The invention provides means for mounting printing cylinders which, although formed of very thin metal sleeves and readily collapsible, nevertheless are maintained in a relatively rigid condition in a printing press by means of air pressure.

The sleeves are electrodeposited metal such as nickel, copper, iron or other pure metal a fraction of a millimeter thick made by known processes such as described in U.S. Pat. No. 2,287,122. Sleeves of plated metal may be used such as for example, tin, chromium or other metals on nickel.

The method of utilizing the sleeves for printing is different from known methods where the pigment is forced through perforated designs in the sleeves because each sleeve is coated with a microthin coating of a photoconductive material of the type which is disclosed in U.S. Pat. No. 4,025,339. On this account the sleeves are imperforate.

The invention herein is directed to a structure which is simple and economical in construction. The problem of mounting the sleeve in a cylindrical configuration is solved in an elegant manner which provides for airtight clamping to a flanged disc at each end of an elongate framework. The framework is readily mounted in a printing press with the sleeve preinflated and/or capable of having the inflation maintained during use.

The invention herein also encompasses means for maintaining the pressure in the sleeve constant notwithstanding changes in temperature and even minor leaks during use and means for varying the circumference of the cylinder minutely by adjustment of internal fluid pressure during use. This latter capability enables the adjustment and refinement for repeat length during operation of the printing press.

The invention also contemplates novel structure coupling the framework to the press in a simple but highly effective manner and a system for using the sleeve of the invention.

SUMMARY OF THE INVENTION

A sleeve of thin-walled metal that is imperforate and highly flexible has a photoconductive coating on the exterior thereof that does not materially affect the flexibility. Such sleeve is mounted on a framework or mandrel in cylindrical form and maintained inflated so that the framework may be coupled into a printing press and the sleeve serves as ink transfer means, especially for effective use in a multicolor printing press.

The supporting device includes a central hollow shaft with hubs at its ends mounting flanged discs these discs having sleeve clamping means on the periphery thereof. The sleeve clamping means include clamping rings on the interior of the discs which can be taken up by fasteners manipulated from the exterior of the discs. The structure at the ends of the central hollow shaft include means for introducing air or other fluid under pressure to the interior of the sleeve either prior to mounting the device in the press or while the device is in use. The invention includes a printing press including means for maintaining the pressure within the sleeve constant, means for stopping the press if the pressure departs from a desired value and means for using the pressure to achieve a degree of registration.

Novel means for coupling the device into the press and a press system for using the invention are disclosed.

DESCRIPTION OF THE PREFERRED EMBODIMENTS

Figure 1:
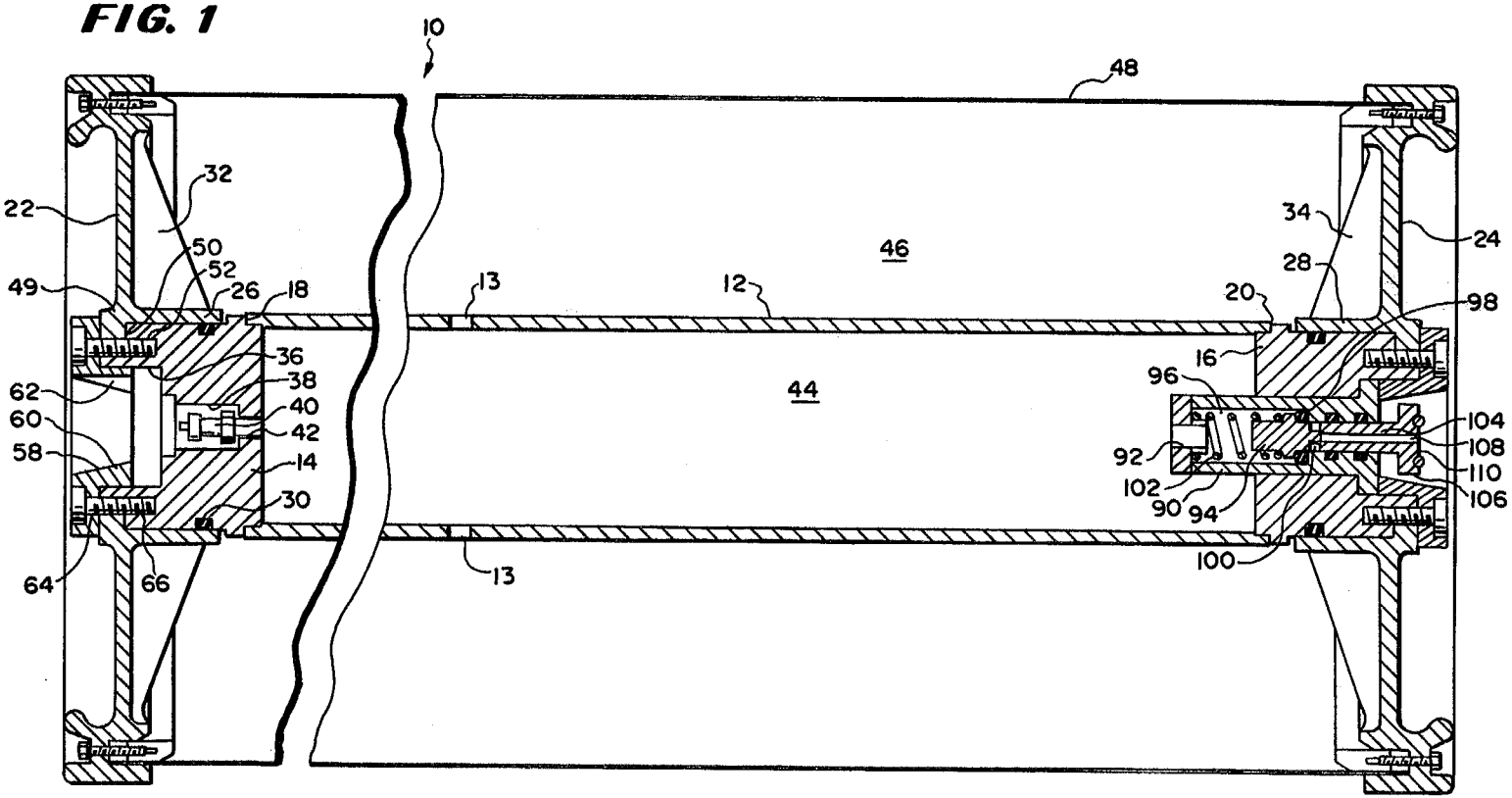
FIG. 1 is a median sectional view through a printing apparatus constructed in accordance with the invention taken generally along the line 1—1 of FIG. 2 and in the indicated direction, parts being broken away.

Generally the apparatus of the invention is designated 10 and comprises a central hollow shaft 12 of metal having a plurality of lateral passageways 13 for air. Other fluids may be used, but for convenience only air will be referred to hereinafter because it is most convenient to use the same in printing establishments.

The ends of the central shaft 12 are closed off by plugs 14 and 16 to which the shaft is welded as indicated at 18 and 20, respectively. A flanged disc is connected to each of these plugs by suitable means, the disc 22 being shown on the left and the disc 24 on the right. These discs 22 and 24 are identical and their construction and functions will be explained in detail later. At this point it is to be noted that the plugs 14 and 16 are generally cylindrical and that each of the discs 22 and 24 includes a hollow cylindrical hub shown at 26 and 28 which telescopically engages the respective plugs 14 and 16 on the exterior thereof, airtight connection being maintained by suitable packing such as O-rings 30.

The discs 22 and 24 include internal radial strengthening ribs 32 and 34 integral with the web or body of each disc, the latter being imperforate to retain the air pressure which is to be maintained on the interior of the device 10.

As noted, the structures at opposite ends of the shaft 12 are different. These represent two embodiments of the invention capable of being used together or separately. In other words, the structure at the left hand end may be used solely or duplicated at the right hand end; the structure at the right hand end may be used solely or duplicated at the left hand end; one of each structure may be used together at opposite ends.

Considering now the structure at the left hand end of the device 10, the plug 14 has a cylindrical axial recess formed in its outer end at 36 and a coaxial socket 38 in the center of the recess 36 in which there is disposed a simple air valve 40 of the so-called Schraeder type which communicates by way of the passageway 42 with the interior 44 of the hollow shaft 12. As explained, the shaft has the lateral passageways 13 by means of which the outer annular chamber 46 and the inner chamber 44 are in communication. As understood, a thin metal sleeve 48 of electrodeposited nickel or the like with an outer photoconductive coating is adapted to be clamped into cylindrical configuration on the device 10 and maintained in inflated condition by air pressure. This is effected by introducing air under pressure by way of the valve 40 into the chamber 44.

The disc 22 has an inwardly directed radial flange 49 which is engaged over the axial end of the plug 14 and provided with perforations and threaded sockets to aid in the assembly of the device. For example, in the device shown, there is a perforation in alignment with each of the ribs 32 thus providing six equally spaced perforations aligned with threaded sockets in the axial end of the plug 14. One such perforation is indicated at 50 and a threaded socket at 52. These perforations and sockets receive machine screws 54 which pass through an outer cap or centering flange member 56 thereby securing the disc 22 to the plug 14.

Figure 2:
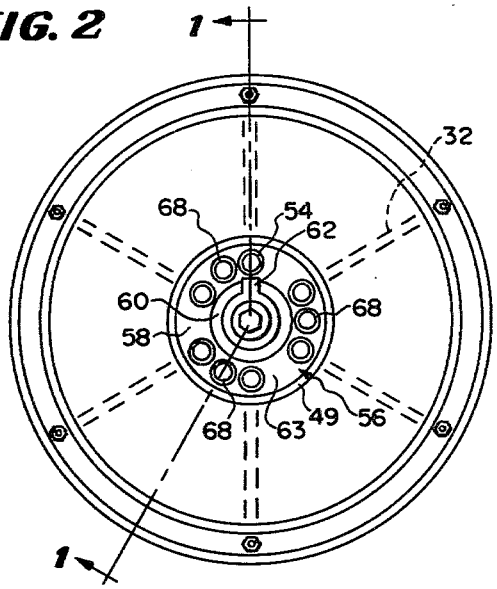
FIG. 2 is an end elevational view of the same taken from the left hand side.

The centering flange member 56 has a central spigot 58 which is cylindrical on its exterior to fit into the recess 36 and is tapered on the interior as indicated at 60 and provided with a keyway at 62. There is also a radial flange portion 63 overlying the flange 49. The member 56 has the aligned perforations in the flange portion 63 for the screws 54 but in addition has several other perforations 64 which are intended to be aligned with threaded sockets 66 formed in the flange 49 to receive other machine screws 68 that pass through the flange portion 63. These screws 68 are only three in number as shown in FIG. 2 and their function is to enable the proper alignment of the disc 22 and the flange member 56 but more importantly, to aid in assembly. The two parts 22 and 56 can be assembled together before the disc 22 is engaged onto the plug.

Figure 3:
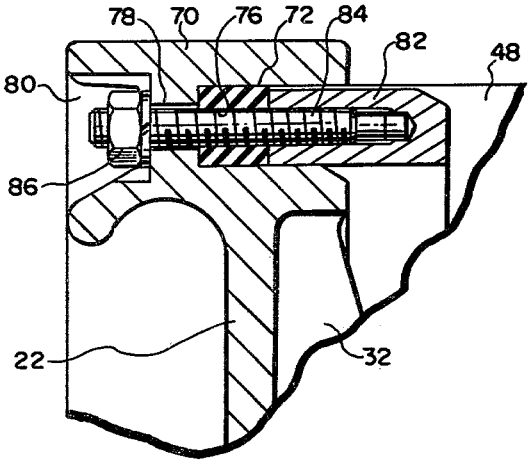
FIG. 3 is a fragmentary detailed view of the sleeve clamping means.

Looking now at FIG. 3 which is an enlarged view of the outer section of the disc 22, there is an annular thickened rim 70 which has an interior (on the right hand face) axially extending annular seat or groove 72 formed fully around its circumference and coaxially centered. There is an elastomeric ring 74 seated in the bottom (left hand end) of the groove 72, the ring 74 being provided with spaced passageways 76 aligned with perforations 78 provided in the rim 70 and opening to an external shallow furrow 80 provided on the exterior of the rim 70. There is a pressure ring 82 of cylindrical configuration which has a plurality of threaded studs 84 secured into its left hand axial end in spaced circumferential position to align with the passageways 76 and perforations 78. The studs 84 extend through these passageways and perforations when the ring 82 is assembled to the disc 22 and are engaged by the nuts 86.

Before the nuts 86 are tightened, the assembly of the apparatus 10 with the sleeve 48 is effected, the sleeve 48 being easily slipped into place as the assembled disc 22, flange member 56 and ring 82 are properly positioned. Thereafter, taking up on the nuts 86 presses the ring 82 against the elastomeric ring 74 which expands in attempting to extrude out of the groove 72 thereby firmly clamping the sleeve 48 in place.

Assuming that the same structure and procedure has been utilized in assembly of the right hand end of the device 10, it can be pumped up to a pressure of say about half an atmosphere through the use of the valve 40 and installed in the printing press. The tapered socket 62 provides for centering and the keyway provides for positive driving coupling of the device with suitable mechanical driving means associated with the printing press.

The right hand end of the device need not have a valve equivalent to the valve 40 but could have a blind end in the equivalent of the tapered socket 60 in the axial end of the plug 16. As a matter of fact, there need not be a second keyway at this location.

In the view of FIG. 1, however, a second form of structure is illustrated which enables various functions to be effected by means of another valve.

Referring now to the right hand end of the device 10 shown in FIG. 1, the only structural difference between that end and the left hand end lies in the valve device mounted at the right hand end. There is a valve housing 90 set into the right hand plug 16 which has a port 92 leading to the chamber 44. The movable valve 94 is seated at the right hand end of the chamber 96 by means of the O-rings 98 against the axial intake port 100 and held there by a spring 102. The spring 102 is of a strength to maintain any pressure which is in the chambers 44 and 46 if the device 10 is removed from a press in which it is installed. When installed in a press, the stem 104 of the valve member 106 pushes the valve 94 off its seat and holds the port 100 open.

The valve member 106 has a coaxial passageway and itself is slidable in the port 100, being kept air tight therein by suitable O-rings. Its external face 110 has O-rings to enable it to make a frictional and air tight connection with a fitting that can supply external air pressure to the device 10. The fitting is not shown in FIG. 1 but is symbolized by the fitting 112 in FIG. 4 as a rotary air connection. The spring 102 keeps the valve member 106 in engagement with the fitting 112.

From this description it is obvious that air can be maintained and supplied to the interior of the sleeve 48 through the valve member 106 from outside sources to pump up the sleeve 48 and maintain it in such condition.

Figure 4:
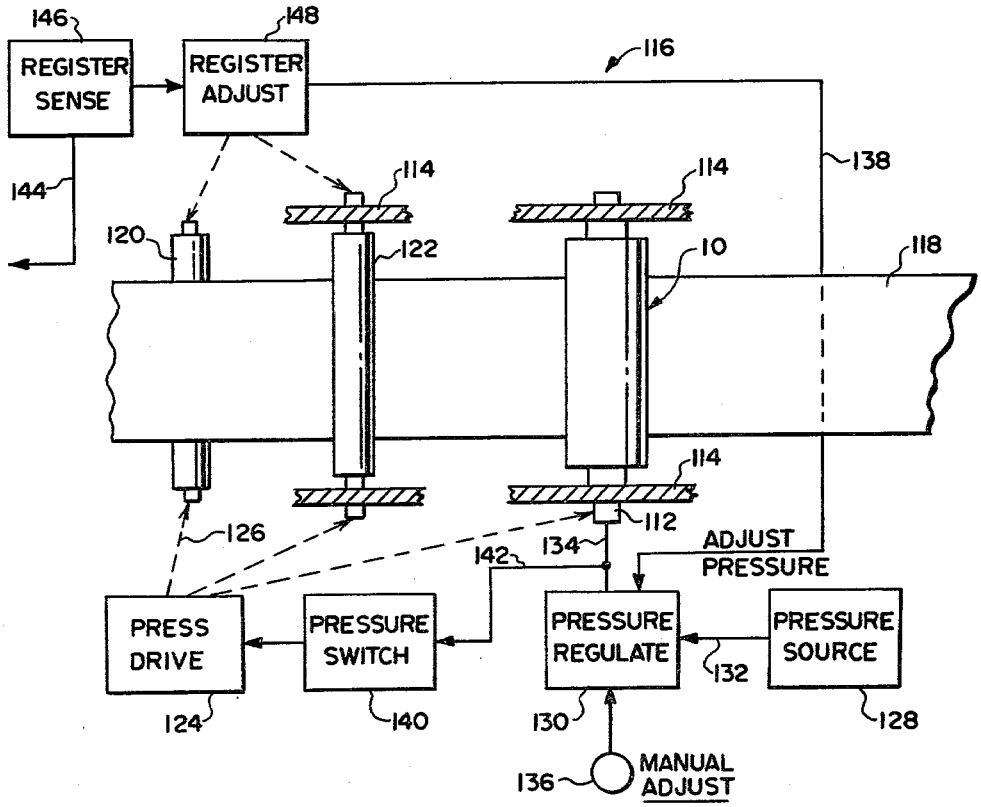
FIG. 4 is a highly diagrammatic view of a printing press having the device 10 installed therein, the structure being such as to utilize an external source of pressure.

FIG. 4 is a highly diagrammatic view of a printing press having the device 10 installed therein, the structure being such as to utilize an external source of pressure.

The device 10 is shown mounted on the frame 114 of a printing press 116, only a very small part of which is diagrammed. The substrate in the form of a web of paper 118 is being guided through the press 116 and may pass over idler and drive rollers, an idler roller being indicated at 120 and a drive roller being indicated at 122 mounted to the frame 114. The press drive 124 may be mechanical, electrical pneumatic or a combination of these, suitable controlled as customary with modern printing presses. The mechanical drive extending to the several rotary parts is indicated by the broken lines 126.

A pressure source is shown at 128 supplying pressure to the fitting 112 by way of the pressure regulator 130 and the air lines 132 and 134. The exact pressure within the sleeve 48 will be controlled by the pressure regulator 130 whose set value may be established manually as by a control 136 or may be varied automatically for certain purposes by way of the line 138.

The pressure switch 140 is sensitive to sudden changes in the pressure in the line 134, being connected to the line 134 by a conduit 142. A large hole suddenly occurring in the sleeve 48 or the bursting thereof will cause a sudden dropping of pressure in the chamber 46. The drop will be experienced by the line 134 and the regulator will attempt to equalize the pressure. This radical change sensed by the switch 140 can be made to operate the switch to turn off the press drive and prevent damage.

Slight air leaks in the chamber 46 can be taken care of by the regulator 130 as a routine matter.

The press 116 will normally have some form of transducer system (not shown) to indicate registration of multiple impressions and a signal from such system can be picked up and transmitted by a line, electrical or pneumatic, as shown at 144 to a sensor 146. This sensor 146 may in turn provide a signal which operates a register adjusting device 148 which is nothing more than an automatic adjustment for the set point of the pressure regulator. It has been found that since the sleeve 48 is made out of metal that is very thin, it is capable of being inflated slightly beyond its normal diameter by a small amount, say a few thousandths of a millimeter. Registration can be affected by this means, to augment ordinary registration control means rather than to replace the same.

The pressure adjustment effected by the register adjust device 148 is applied to the pressure regulator 130 by way of the line 138.

Variations are capable of being made without departing from the spirit or scope of the invention as defined by the appended claims.

What it is desired to secure by Letters Patent of the United States is:

1. Apparatus for supporting an imperforate thin walled metal sleeve which is flexible and collapsible when unsupported, for use as an ink transfer device in a printing press or the like which comprises:

A. an elongate hollow shaft having a plug at opposite ends thereof and lateral passageways through the shaft wall between the ends thereof, B. each of the plugs having structure to enable the apparatus to be removably coupled to a printing press and be rotated by the press drive on an axis defined by the axis of the hollow shaft, C. an imperforate disc connected to each of the plugs coaxial with said shaft and having a circumferential groove on its face located radially inward of its outer edge, the diameter of the grooves being substantially greater than the outer diameter of the hollow shaft, said grooves facing one another axially and providing seats for the ends of said thin walled metal sleeve adapted to be engaged therein and extending between said discs spaced outwardly of said hollow shaft, D. an elastomeric O-ring engaged in each groove and a locking ring also axially movable into said groove and adapted to engage said O-ring and press same into its groove whereby to clamp the ends of the thin walled sleeve into the respective grooves while forming said ends into circles coaxial with said shaft, E. said apparatus providing no support for the said sleeve when so installed between the clamped ends thereof other than fluid pressure, F. means for securing the locking rings in said clamped engagement and G. a valve in at least one of said plugs to enable the admission of fluid under pressure into the interior of the sleeve when said sleeve is so mounted in said apparatus, the valve being arranged to retain the fluid pressure in the apparatus.

2. The apparatus as claimed in claim 1 in which the valve is capable of being opened to connect the apparatus to an external source of pressure while mounted in a printing press and rotating.

3. The apparatus as claimed in claim 2 in which the valve is arranged automatically to close but retain said pressure if the apparatus is removed from said printing press.

4. The apparatus as claimed in claim 1 in which the means for securing the locking rings comprise bolts extending through said disc from the exterior faces thereof and into engagement with the clamping rings on the interior of said grooves.

5. The apparatus as claimed in claim 1 in which the said structure to enable coupling of said apparatus to a printing press comprise tapered sockets formed in each respective plug coaxial with said shaft and at least one of said sockets having key means, said sockets adapted to be engaged with male members connected with said printing press, at least the keyed socket adapted to be engaged with a male member that is rotary.

6. A printing press which comprises:

A. a printing roller adapted to apply indicia to a moving substrate by pigment transfer, B. support means for mounting the roller and for leading the substrate to move relative to the roller, C. drive means to move the substrate and rotate the roller, D. the printing press including a source of fluid pressure, E. the printing roller including means for mounting a thin walled, imperforate metal sleeve on the roller, said sleeve being sealed at its ends and inflated to a cylindrical configuration and serving as the pigment transfer medium of said roller, F. means providing a rotating coupling between said source of fluid pressure and the interior of the sleeve whereby to supply fluid pressure on the interior of the sleeve while the roller is rotating, G. regulating means associated with said source for maintaining the pressure of fluid within said sleeve in a predetermined range, H. the sleeve being totally unsupported between its ends whereby the cylindrical configuration thereof between the ends is maintained solely by internal fluid pressure.

7. A printing press as claimed in claim 6 in which there is a pressure responsive device associated with said source and connected with said drive means acting to disable the drive means when the fluid pressure within said sleeve decreases to a value outside of said range.

8. A printing press as claimed in claim 6 in which said press includes registration control means adapted to produce a signal indicative of registration of said indicia with other indicia of said substrate and means responsive to said signal connected with said regulating means for changing said range in accordance with said signal.

* * * * *